US008851721B2

(12) United States Patent
Woodward

(10) Patent No.: US 8,851,721 B2
(45) Date of Patent: Oct. 7, 2014

(54) HYBRID PROJECTOR LED LOW BEAM HEADLAMP

(75) Inventor: Ronald Owen Woodward, Yorktown, VA (US)

(73) Assignee: Magna International, Inc., Aurora, Ontario (CA)

( * ) Notice: Subject to any disclaimer, the term of this patent is extended or adjusted under 35 U.S.C. 154(b) by 79 days.

(21) Appl. No.: 13/811,544

(22) PCT Filed: Jul. 19, 2011

(86) PCT No.: PCT/US2011/001279

§ 371 (c)(1),
(2), (4) Date: Jan. 22, 2013

(87) PCT Pub. No.: WO2012/011947

PCT Pub. Date: Jan. 26, 2012

(65) Prior Publication Data

US 2013/0120988 A1 May 16, 2013

Related U.S. Application Data

(60) Provisional application No. 61/399,968, filed on Jul. 20, 2010.

(51) Int. Cl.

| | |
|---|---|
| ***F21V 1/00*** | (2006.01) |
| ***F21S 8/10*** | (2006.01) |
| ***F21V 13/04*** | (2006.01) |

(52) U.S. Cl.

CPC ..... *F21V 13/04* (2013.01); *F21S 48/137* (2013.01); *F21S 48/1104* (2013.01); *F21S 48/1388* (2013.01); *F21S 48/321* (2013.01); *F21S 48/1266* (2013.01); *F21S 48/1323* (2013.01); *F21S 48/1216* (2013.01); *F21S 48/1154* (2013.01)

USPC ..... 362/509; 362/520; 362/538

(58) Field of Classification Search

USPC ..... 362/509, 520, 538, 235, 249.02

See application file for complete search history.

(56) References Cited

U.S. PATENT DOCUMENTS

| | | | | |
|---|---|---|---|---|
| 6,776,513 | B2 * | 8/2004 | Albou | 362/507 |
| 7,946,743 | B2 * | 5/2011 | Natsume et al. | 362/516 |

(Continued)

FOREIGN PATENT DOCUMENTS

| | | |
|---|---|---|
| DE | 2644385 | 4/1978 |
| DE | 112008002141 T5 | 7/2010 |

(Continued)

OTHER PUBLICATIONS

International Search Report PCT/US2011/001279 mailed on Dec. 23, 2011.

*Primary Examiner* — Evan Dzierzynski

(74) *Attorney, Agent, or Firm* — Harness, Dickey & Pierce, P.L.C.

(57) ABSTRACT

The optics system is a lamp assembly which produces the desired beam pattern by using a reflector, a lens, a retainer lens, and an LED as a light source. The lamp assembly has three main components (the reflector, the lens, and the retainer lens) that maintain proper alignment between the light source and the reflector, the lens, and the retainer lens. The optical system collects substantially 100% of the light from the light source while effectively shaping the beam pattern using both cylindrical and revolved reflector elements. The lens has a saddle-shape which is used with the surface of a revolution to eliminate any "dogbone" light pattern shape. The use of a reflective element forms the foreground of the beam pattern.

16 Claims, 6 Drawing Sheets

(56) References Cited

U.S. PATENT DOCUMENTS

| | | | | |
|---|---|---|---|---|
| 2004/0184280 | A1 | 9/2004 | Ishida et al. | |
| 2005/0190572 | A1* | 9/2005 | Komatsu et al. | 362/538 |
| 2006/0158887 | A1 | 7/2006 | Holder | |
| 2006/0209552 | A1 | 9/2006 | Okada et al. | |
| 2006/0209558 | A1* | 9/2006 | Chinniah et al. | 362/545 |
| 2007/0109775 | A1 | 5/2007 | Chen | |
| 2007/0236953 | A1 | 10/2007 | Nakazawa et al. | |
| 2009/0302343 | A1 | 12/2009 | Sato | |

FOREIGN PATENT DOCUMENTS

| | | |
|---|---|---|
| EP | 1970617 | 9/2008 |
| EP | 2386795 | 11/2011 |
| WO | 20060107287 A1 | 10/2006 |

* cited by examiner

FIG. 10
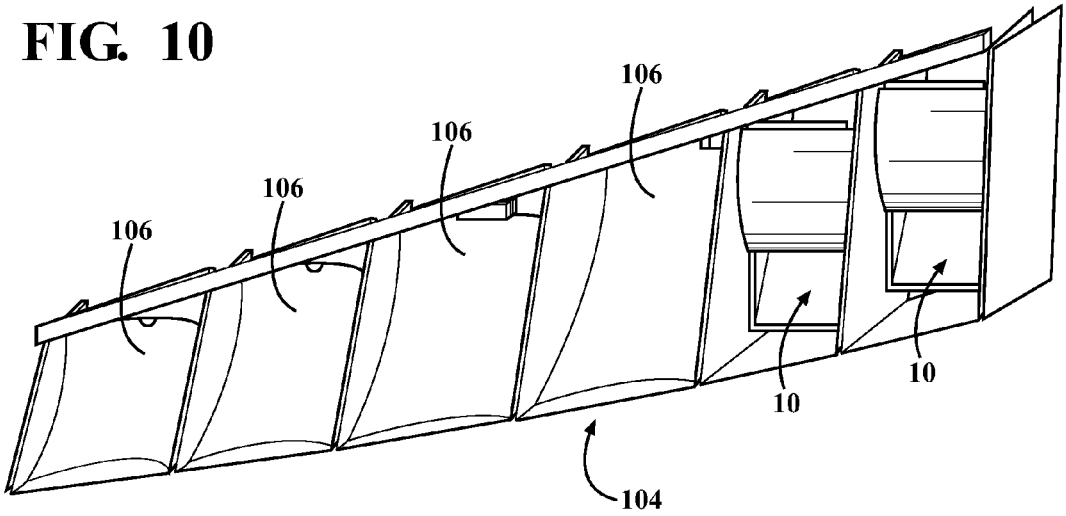
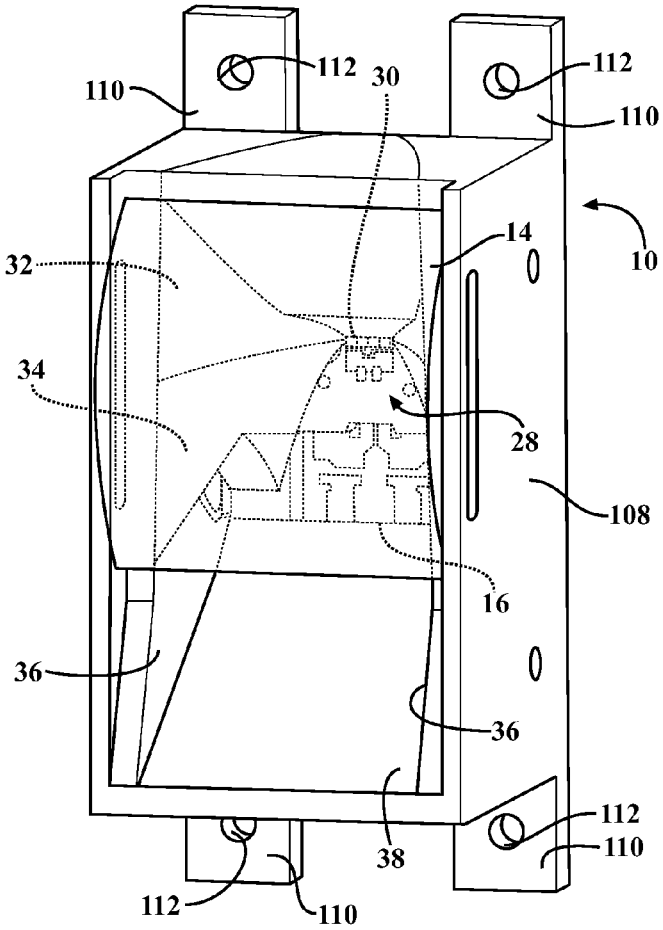
FIG. 11

HYBRID PROJECTOR LED LOW BEAM HEADLAMP

CROSS-REFERENCE TO RELATED APPLICATIONS

This application claims priority to U.S. Provisional Application No. 61/399,968 filed on Jul. 20, 2010. This application also claims priority to the PCT application PCT/US2011/001279 filed on 19 Jul. 2011. The disclosure of the above application is incorporated herein by reference.

FIELD OF THE INVENTION

The present invention relates to an optical system which collects substantially all of the light emitted from a light source to produce a desired beam pattern.

BACKGROUND OF THE INVENTION

Current headlamps which incorporate the use of a light emitting diode (LED) use a projector type lens, reflector optics, or closely coupled optics. These types of headlamps suffer from low optical efficiency, high cost, or poor beam pattern distribution.

Accordingly, there exists a need for a headlamp having an LED light source which also includes an optical system that is able to collect substantially all of the light produced by the LED light source, and produce a desired beam pattern efficiently.

SUMMARY OF THE INVENTION

The optical system of the present invention solves the drawbacks of previous designs by using an optical system that collects substantially 100% of the light emitted from the light source and effectively directs it to produce the desired beam pattern. This is achieved by a complex combination of different optical control methods including reflector and lens optics. More specifically, the optics system is a lamp assembly which produces the desired beam pattern by using a reflector, a lens, a retainer lens, and an LED as a light source. The cost of producing the lamp assembly according to the present invention is controlled by a design that reduces the optical part count to three main components that maintain proper alignment between the light source and the reflector, the lens, and the retainer lens.

The innovative optical system of the present invention collects substantially 100% of the light from the light source while effectively shaping the beam pattern using both cylindrical and revolved reflector elements. The combination of a saddle-shaped lens element and the surface of a revolution eliminates any "dogbone" light pattern shape, and the use of a reflective element forms the foreground of the beam pattern. The present invention has the combination of a prism and culminating lens with a culminating and flat reflective reflector. Another feature of the present invention is the integration of retaining features in a retainer lens and the reflector.

In one embodiment, the lamp assembly of the present invention has a light source in the form of a light emitting diode, a reflector operable for producing a desired beam pattern with light emitted from the light emitting diode, and at least one cylindrical extrusion sidewall formed as part of the reflector which is operable for forming a central portion of the desired beam pattern.

The present invention also includes a vertical culminating reflector segment formed as part of the reflector, and is operable for controlling a vertical edge profile of the wide angle spread light portion and the hotspot portion of the desired beam pattern. The lamp assembly also includes two lenses, a lens mounted to the reflector operable for forming a foreground portion of the desired beam pattern, and a retainer lens connected to and supporting a portion of the reflector operable for directing a portion of the light emitted from the light emitting diode toward the vertical culminating reflector segment. The retainer lens, the light emitting diode, and the reflector mounted to a printed circuit board (PCB).

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 10 is a perspective view of a hybrid optic LED headlamp used as part of an array of a headlamp for an automobile, according to the present invention; and FIG. 11 is a perspective view of an alternate embodiment of a hybrid optic LED headlamp, according to the present invention.

DETAILED DESCRIPTION OF THE PREFERRED EMBODIMENTS

The following description of the preferred embodiment(s) is merely exemplary in nature and is in no way intended to limit the invention, its application, or uses.

Figure 1:
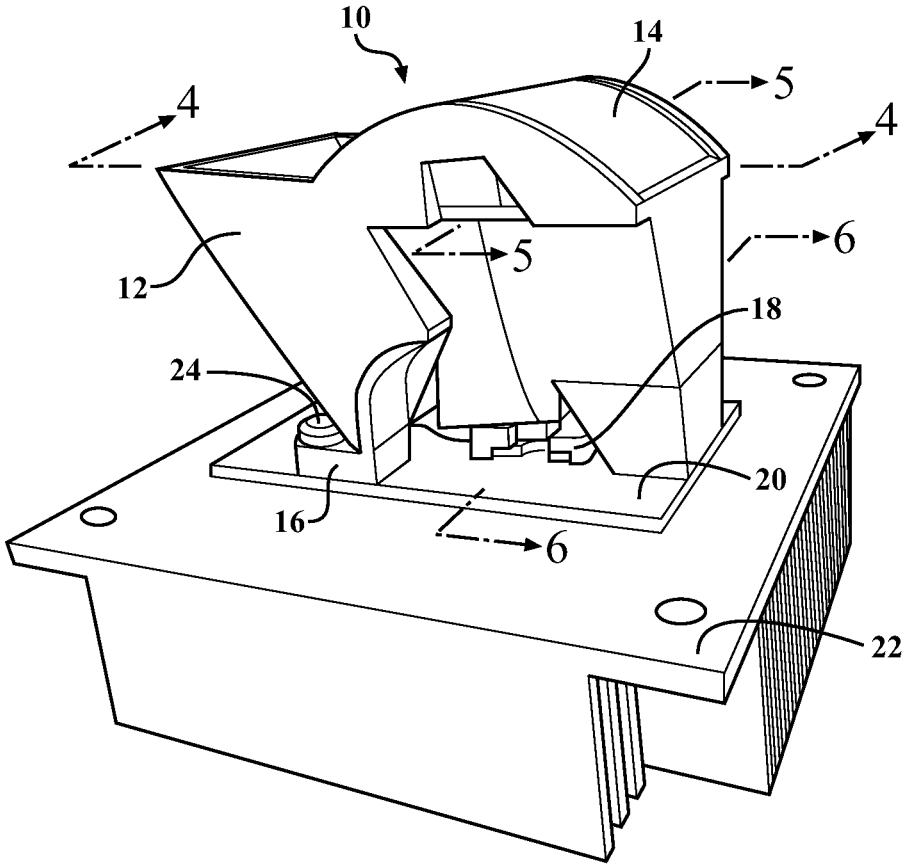
FIG. 1 is a first perspective view of a hybrid optic LED headlamp, according to the present invention.
Figure 2:
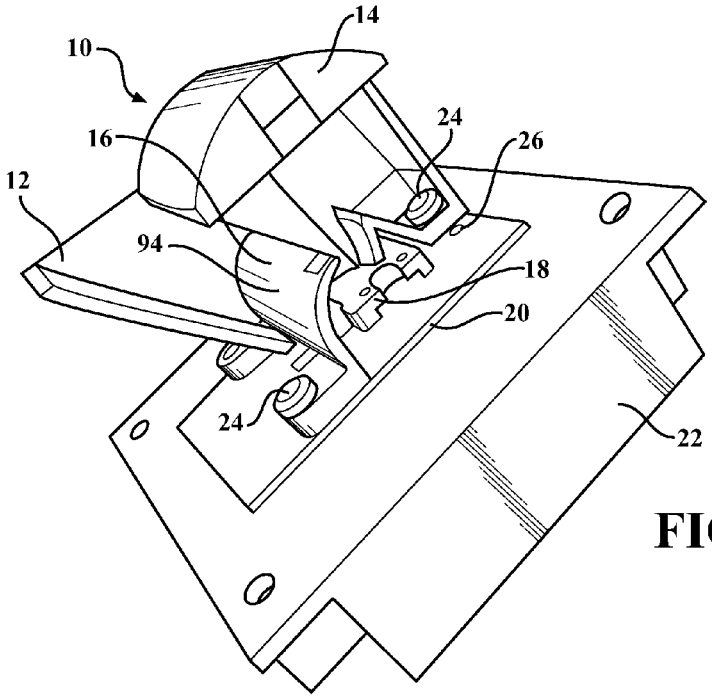
FIG. 2 is a second perspective view of a hybrid optic LED headlamp with half of the reflector removed, according to the present invention.

Referring to the Figures generally, and with specific reference to FIG. 1, a lamp assembly according to the present invention is shown generally at 10. The lamp assembly 10 includes a reflector 12, a lens 14, a retainer lens 16, an LED 18, a printed circuit board (PCB) 20, a heatsink 22, and a plurality of fasteners 24. Referring now to FIG. 2, a perspective view of the lamp assembly 10 is shown with a section of the reflector 12 removed for a better view of the interior of the assembly 10. One of the fasteners 24 in the interior of the reflector 12 is visible, as well as one of a plurality of apertures 26 present in the PCB 20. Some of the apertures 26 are used for providing proper alignment, others are used for receiving one of the fasteners 24, the function of which will be described later.

Figure 3:
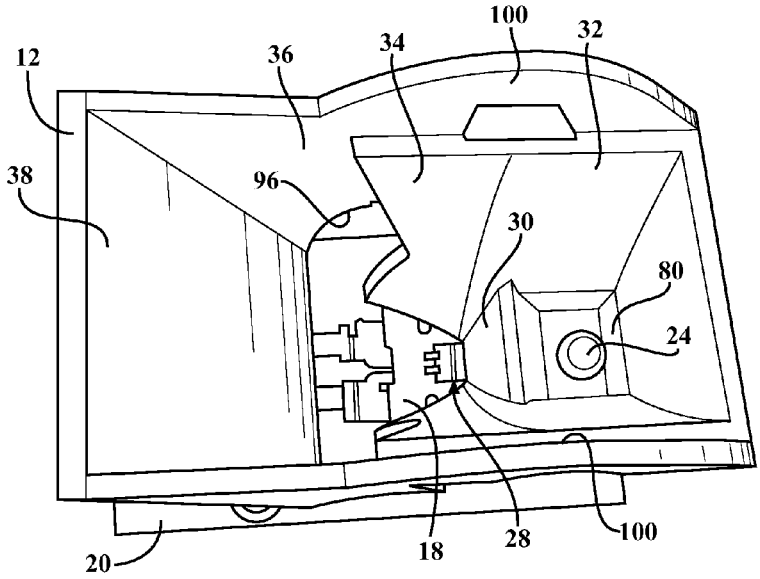
FIG. 3 is a third perspective view of a hybrid optic LED headlamp with the lens and retainer lens removed, according to the present invention.

Referring now to FIG. 3, the interior of reflector 12 is shown having the lens 14 and the retainer lens 16 removed, allowing the light emitting area, shown generally at 28, of LED 18 to be seen more clearly. The assembly 10 includes a foreground illumination reflector 30, which collects at least some light emitted from the light emitting area 28 and directs it forward out of the reflector 12 such that the light reflected by the foreground illumination reflector 30 passes through the lens 14. A cylindrical extrusion sidewall 32 is also part of the reflector 12; the cylindrical extrusion sidewall 32 is adjacent to and extends away from the foreground illumination reflector 30. The cylindrical extrusion sidewall 32 reflects the light emitted from the LED 18, and concentrates the light to form the central portion of the beam pattern. At least one revolution 34 is formed with the cylindrical extrusion sidewall 32. In this embodiment, there are two revolutions 34 which reflect light to form the hotspot portion of the beam pattern and maintains a flat angular presentation of the light source image, thereby keeping the hotspot tight vertically. The reflector 12 also includes side wall reflector segments 36; the side wall reflector segments 36 are connected to the cylindrical extrusion sidewall 32 and the revolution 34. The side wall reflector segments 36 are substantially flat, and function to reflect light from the LED 18 to produce wide angle spread light.

Connected and adjacent to the side wall reflector segments 36 is a vertical culminating reflector segment 38, and the vertical culminating reflector segment 38 is operable with the retainer lens 16 (shown in FIGS. 1 and 2) to control the vertical edge profile of the wide angle spread light and a portion of the hotspot light reflected from surface of revolution 34.

Figure 4:
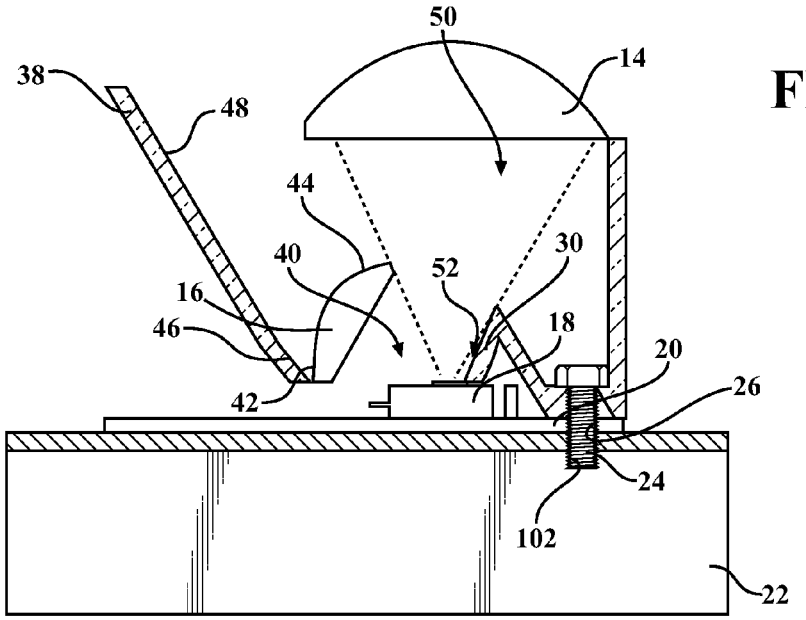
FIG. 4 is a sectional side view of the hybrid optic LED headlamp taken along lines 4-4 of FIG. 1, according to the present invention.

Referring now to FIG. 4, the control of how all the light emitted from the LED 18 by the assembly 10 is shown. The light emitting area 28 of the assembly 10 has several zones through which the light from the LED 18 is directed. Some of the light emitted from the LED 18 passes through a bottom zone, generally shown at 40, and is intercepted by the retainer lens 16. The retainer lens 16 has two distinct areas, a prism area 42, which simply bends the light while maintaining a general dispersion angle, and a focusing section 44 that generally culminates the light. All of the light that passes through the prism area 42 and the focusing section 44 is redirected forward and aligned horizontally by a first reflector segment 46 formed as part of the vertical culminating reflector segment 38, and the reflector segment 46 then focuses the dispersive light from prism area 42. A second reflector segment 48 is also formed as part of the vertical culminating reflector segment 38, and the reflector segment 48 redirects the already culminated light from the focusing section 44. The light emitting area 28 of the assembly 10 also has a forward zone, generally shown at 50, and the light emitted that passes through the forward zone 50 is intercepted and culminated by lens 14. The light emitted that passes through a top zone, generally shown at 52, is intercepted by the foreground illumination reflector 30, and is directed towards the lens 14 that culminates the light into a portion of the foreground of the beam pattern.

Figure 5:
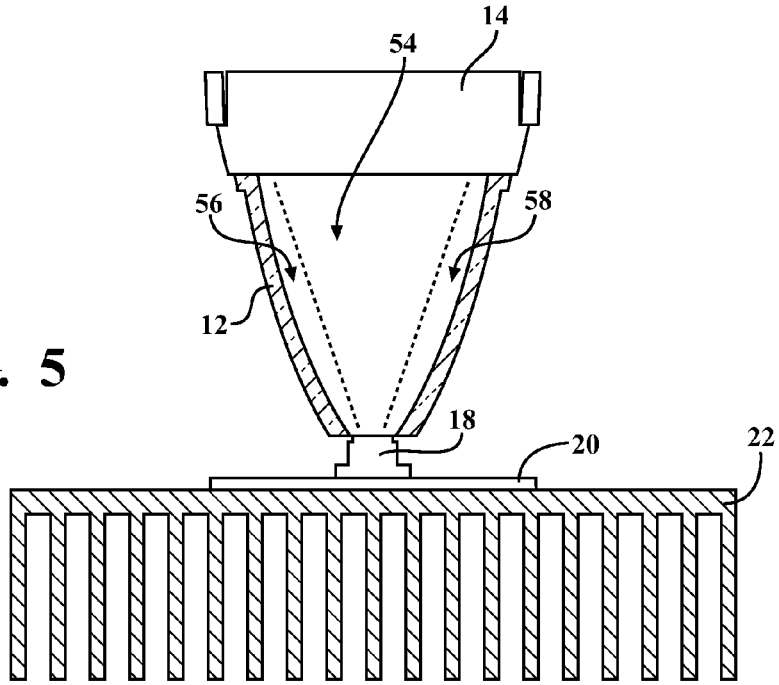
FIG. 5 is a sectional bottom view of a lens and a heat sink used for a hybrid optic LED headlamp taken along lines 5-5 of FIG. 1, according to the present invention.

With reference to FIG. 5, a bottom view through the center of the lens 14 is shown illustrating how all of the light is controlled as the light from the LED 18 is emitted outwardly toward the lens 14. Again, the light emitting area 28 has several zones in which the light from the LED 18 passes through. Light emitted from the LED 18 in a center zone 54 passes through the lens 14 and contributes to the medium spread portion of the beam pattern. Light emitted from LED 18 in a left zone 56 and a right zone 58 is culminated horizontally, the light then passes through the lens 14 contributing to the hotspot portion of the beam pattern.

Figure 6:
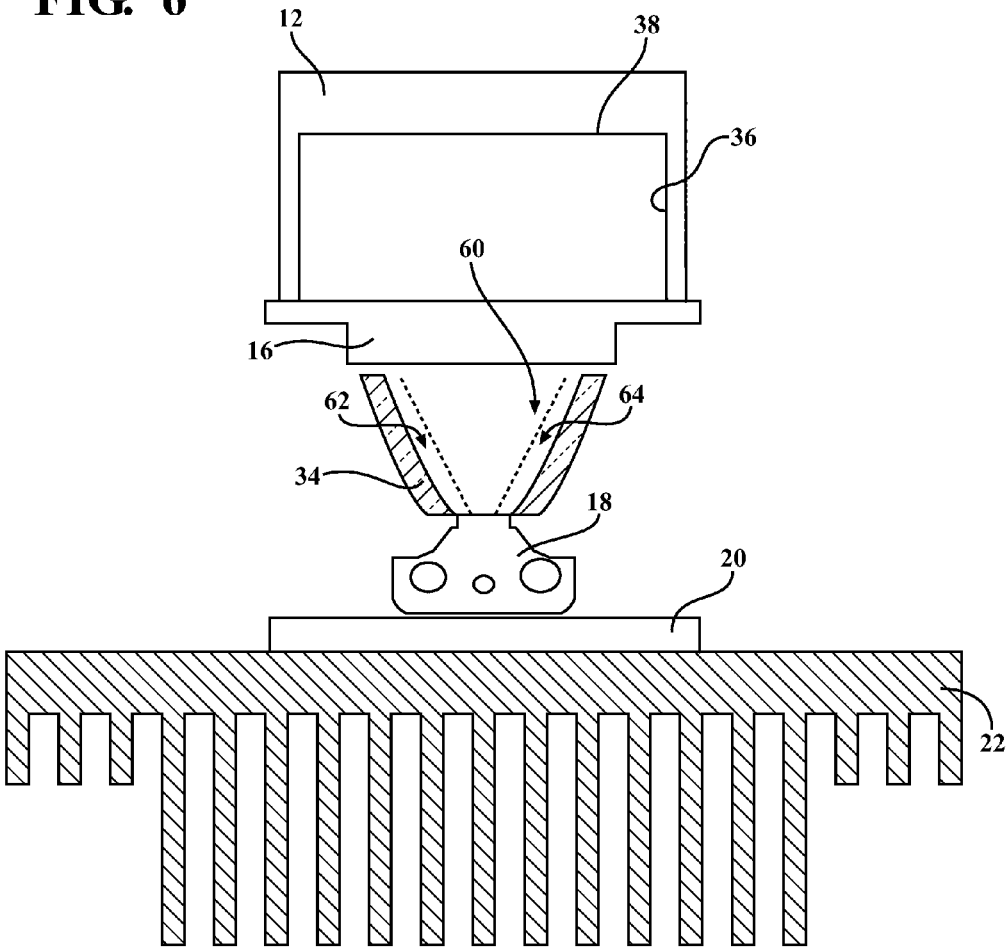
FIG. 6 is a sectional bottom view of a retainer lens, an LED, and a heat sink used for a hybrid optic LED headlamp taken along lines 6-6 of FIG. 1, according to the present invention.

FIG. 6 is a sectional bottom view through the retainer lens 16 and reflector 12 illustrating how all of the light is controlled as the light from the LED 18 is emitted outwardly from the reflector 12 in the area not covered by the lens 14. Light emitted from the LED 18 into a center section 60 of the light emitting area 28 passes through the retainer lens 16 and then either reflects off the side wall reflector segment 36, or reflects directly off the vertical culminating reflector segment 38. The light reflected by these segments 36,38 makes up the widest spread portion of the beam pattern. There are also areas the light passes through to form part of the hotspot portion of the beam pattern. Light passing through the right area 62 and left area 64 is reflected off the surface of the revolution 34 and then through retainer lens 16 and reflects off the vertical culminating reflector segment 38. This portion of the light contributes to the near hotspot area of the beam pattern.

Figure 7:
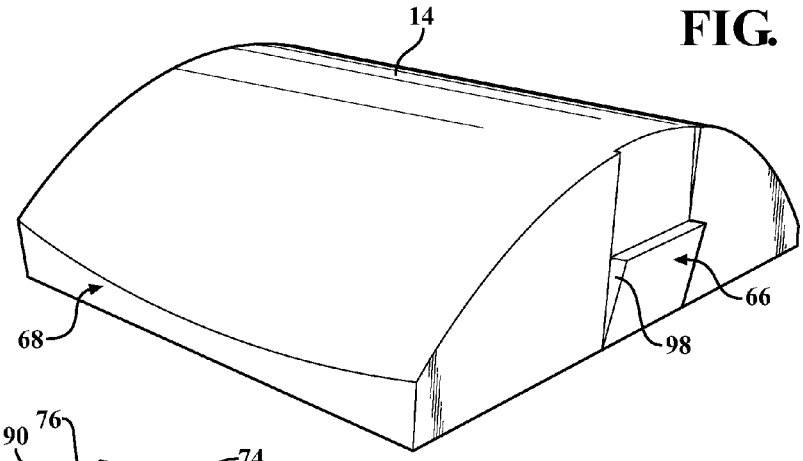
FIG. 7 is a perspective view of a lens used for a hybrid optic LED headlamp, according to the present invention.

FIG. 7 is an enlarged perspective view of the lens 14. Molded into the lens 14 is a retention snap feature, shown generally at 66. Instead of having a cylindrical shape, the lens 14 has a saddle shape achieved by the use of a saddle surface, shown generally at 68, that corrects the dogbone beam pattern shape in the wide spread light portion of the beam pattern that would occur if the lens 14 were of a simple cylindrical shape.

Figure 8:
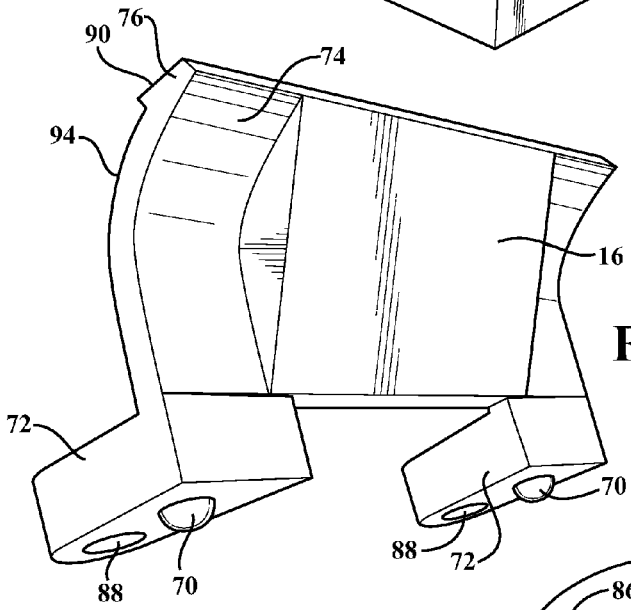
FIG. 8 is a perspective view of a retainer lens used for a hybrid optic LED headlamp, according to the present invention.

Referring now to FIG. 8, details of the retainer lens 16 are shown. The retainer lens 16 has an alignment nub 70 which locates the retainer lens 16 relative to the LED 18. The alignment nub 70 locates in one of the apertures 26 in the PCB 20 shown in FIG. 2. The lens 16 also has one or more attachment legs 72; each attachment leg 72 has an aperture 88 to receive one of the fasteners 24. The lens 16 also has a relief area 74, which allows for flexing of a snap feature 76 during assembly.

Figure 9:
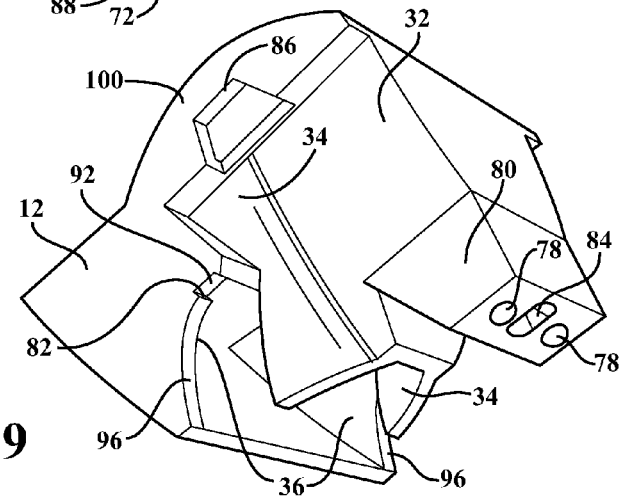
FIG. 9 is a perspective view of a reflector used for a hybrid optic LED headlamp, according to the present invention.

FIG. 9 shows further details of the reflector 12 with the lens 14 and retainer lens 16 removed. The reflector 12 has alignment nubs 78 formed as part of a reflector standoff feature 80. The alignment nubs 78 locate the reflector 12 relative to the LED 18 by locating in apertures 26 in the PCB 20 shown in FIG. 2. The cylindrical extrusion sidewalls 32 are mounted on the reflector standoff feature 80. The reflector standoff feature 80 properly positions the reflector 12 to the proper height above the LED 18. The reflector 12 has a snap feature 82 which engages the snap feature 76 on the retainer lens 16 when assembled. There is an aperture 84 which allows for attachment with one of the fasteners 24. Another aperture 86 provides a mating snap feature for the snap feature 66 on the lens 14. Use of a high reflective coating like silver further improves efficiency over the use of aluminum.

Referring again to the Figures generally, during assembly the retainer lens 16 is assembled to the PCB 20. One of the fasteners 24 extends through a corresponding aperture 88, through one of the apertures 26 in the PCB 20, and into an aperture (not shown) formed as part of the heat sink 22, securing the retainer lens 16 to the PCB 20 and heat sink 22. In this embodiment, there are two of the fasteners 24 which extend through the corresponding apertures 88 formed as part of each of the attachment legs 72. Each alignment nub 70 is disposed in a corresponding aperture 26 when the retainer lens 16 is connected to the PCB 20, providing proper alignment of the retainer lens 16 relative to the PCB 20. The reflector 12 is then attached to the retainer lens 16 using the snap feature 76 and the snap feature 82. More specifically, the snap feature 76 includes an angled portion 90 which deflects and snaps into place in a recess 92 formed as part of the snap feature 82. When the retainer lens 16 and the reflector 12 are in place, an arcuate surface 94 of the retainer lens 16 is in contact with a corresponding arcuate surface 96 formed as part of each of the side wall reflector segments 36.

Once the retainer lens 16 is in place and the reflector 12 is connected to the retainer lens 16, another one of the fasteners 24 is inserted through the aperture 84 formed as part of the reflector standoff feature 80, and then extends into one of the apertures 26 of the PCB 20 and into an aperture 102 formed as part of the heat sink 22, best shown in FIGS. 2-4. The alignment nubs 78 on the bottom of the reflector standoff feature 80 are received into a corresponding aperture 26 of the PCB 20, providing the correct positioning of the reflector 12 relative to the LED 18.

The lens 14 is then attached to the reflector 12 through the use of the retention snap features 66 being received into the corresponding apertures 86. More specifically, there is a snap feature 66 on each side of the lens 14, and each snap feature 66 has an angled portion 98 which deflects corresponding arcuate wall portions 100 formed as part of the side wall reflector segments 30 as the lens 14 is moved past the wall portions 100. Once the lens 14 has moved enough, the angled portions 98 are in alignment with the apertures 86, allowing the angled portions 98 to move into the apertures 86 as the wall portions 100 are no longer deflected. The arcuate wall portions 100 have substantially the same curvature as the lens 14, best seen in FIG. 1.

Once assembled, the lamp assembly 10 provides high efficiency by collecting substantially 100% of the light produced by the LED 18, and shaping the beam pattern using the lenses 14,16, the reflector 30, and the various sidewalls 32, revolution 34, and segments 36,38. Furthermore, the lamp assembly 10 is easily assembled to the PCB 20 and heat sink 22.

FIG. 10 shows an application of the lamp assembly 10 according to the present invention, which includes an array, shown generally at 104 used for functioning as a headlamp for an automobile. There are two lamp assemblies 10 on one end of the array, and a plurality of lighting devices 106 which also make up part of the array 104. The lamp assemblies 10 are used to produce a beam pattern having a hot sport portion, and medium spread portion.

Referring to FIG. 11, an alternate embodiment of the lamp assembly 10 is shown, with like numbers referring to like elements. However, in this embodiment, the lamp assembly 10 is disposed within a casing 108 having several flanges 110 which include apertures 112. Several of the fasteners 24 may be extended through the apertures 112 to connected the casing 108 to a corresponding mount on a vehicle, allowing the lamp assembly 10 to be located as desired.

The description of the invention is merely exemplary in nature and, thus, variations that do not depart from the essence of the invention are intended to be within the scope of the invention. Such variations are not to be regarded as a departure from the spirit and scope of the invention.

What is claimed is:

1. A headlamp assembly, comprising:

a housing;

a light emitting device arranged in the housing and having a planar emitting surface from which light is emitted along an optical axis to form a beam pattern;

a lens arranged in the housing to receive a first portion of the light emitted from the light emitting device and operates to direct the light in a direction substantially parallel to the optical axis, the lens having only one incident surface upon which the first portion of the light is incident thereon and the incident surface being planar and oriented at substantially forty-five degrees in relation to the optical axis; and a reflector arranged in the housing to receive a second portion of the light emitted from the light emitting device and reflect the second portion of the light in a direction substantially parallel to the optical axis.

2. The headlamp assembly of claim 1 wherein the lens operates to control vertical dimension of the beam pattern generated by the headlamp assembly.

3. The headlamp assembly of claim 1 wherein the lens is formed in shape of a cylinder cut in half along a longitudinal axis thereof, thereby defining the planar incident surface and a convex surface opposing the planar incident surface.

4. The headlamp assembly of claim 3 wherein the curved surface of the lens is truncated on at least one end.

5. The headlamp assembly of claim 1 further comprises a second lens arrange along the optical axis, the second lens having an incident surface facing the emitting surface of the light emitting device.

6. The headlamp assembly of claim 5 wherein the second lens having a saddle shape.

7. The headlamp assembly of claim 5 wherein the lens, the second lens and the reflector are configured to collect substantially all of the light emitted by the light emitting device.

8. The headlamp assembly of claim 1 wherein the light emitting device is further defined as a light emitting diode.

9. A headlamp assembly operable to project light in a forward direction, comprising:

a housing;

a light emitting device arranged in the housing and having a planar emitting surface from which light is emitted along an optical axis to form a beam pattern;

a lens arranged in the housing to receive a first portion of the light emitted from the light emitting device and operates to direct the light in a direction substantially parallel to the forward direction, the lens having only one incident surface upon which the first portion of the light is incident thereon and the incident surface being planar and oriented at substantially forty-five degrees in relation to the optical axis; and a reflector arranged in the housing to receive a second portion of the light emitted from the light emitting device and reflect the second portion of the light in a direction substantially parallel to the optical axis.

10. The headlamp assembly of claim 9 wherein the lens operates to control vertical dimension of the beam pattern generated by the headlamp assembly.

11. The headlamp assembly of claim 9 wherein the lens is formed in shape of a cylinder cut in half along a longitudinal axis thereof, thereby defining the planar incident surface and a convex surface opposing the planar incident surface.

12. The headlamp assembly of claim 11 wherein the curved surface of the lens is truncated on at least one end.

13. The headlamp assembly of claim 9 further comprises a second lens arrange along the optical axis, the second lens having an incident surface facing the emitting surface of the light emitting device.

14. The headlamp assembly of claim 11 wherein the second lens having a saddle shape.

15. The headlamp assembly of claim 9 wherein the lens, the second lens and the reflector are configured to collect substantially all of the light emitted by the light emitting device.

16. The headlamp assembly of claim 9 wherein the light emitting device is further defined as a light emitting diode.

* * * * *